United States Patent [19]

Gibson

[11] Patent Number: 4,918,457

[45] Date of Patent: Apr. 17, 1990

[54] ANTENNA FORMED OF STRIP TRANSMISSION LINES WITH NON-CONDUCTIVE COUPLING

[75] Inventor: Peter J. Gibson, Crawley, England

[73] Assignee: U.S. Philips Corporation, New York, N.Y.

[21] Appl. No.: 302,077

[22] Filed: Jan. 23, 1989

[30] Foreign Application Priority Data

Dec. 20, 1985 [GB] United Kingdom ..... 8531502

[51] Int. Cl.[4] ..... H01Q 1/38

[52] U.S. Cl. ..... 343/700 MS; 343/853

[58] Field of Search ..... 343/700 MS, 853, 829, 343/830, 846

[56] References Cited

U.S. PATENT DOCUMENTS

| | | | |
|---|---|---|---|
| 4,203,116 | 5/1980 | Lewin | 343/700 MS |
| 4,376,921 | 3/1983 | Dickens et al. | 333/116 |
| 4,423,392 | 12/1983 | Wolfson | 343/700 MS |
| 4,475,107 | 10/1984 | Makimoto et al. | 343/700 MS |

FOREIGN PATENT DOCUMENTS 2107936 5/1983 United Kingdom .

OTHER PUBLICATIONS

McDonough, J. A., "Recent Developments in the Study of Printed Antennas", IRE National Convention Record, 5, pt. 1, pp. 173–176, 1957.

Bazire, T. W. et al., "A Printed Antenna/Radome (Radant) for Airborn Doppler Navigations Radar", IEE Conference on Antennas for Aircraft and Spacecraft. London, IEE Conf. Pub. No. 128, pp. 35–40, Jun. 1975.

Scorer, M., Adams, B. J., "Printed Circuit Antenna for a Doppler Navigator", Colloquium on Advances in Printed Antenna Design and Manufacture, IEE Colloquium Digest n 1982/19., pp. 7.1–7.8, 1982.

*Primary Examiner*—Rolf Hille
*Assistant Examiner*—Doris J. Johnson
*Attorney, Agent, or Firm*—Robert J. Kraus

[57] ABSTRACT

A generally planar antenna formed in strip transmission line comprises a two-dimensional array of antenna elements (11) coupled to a plurality of secondary feeders (10) each coupled at at least one end to a primary feeder (4). In order that the level of coupling between the primary feeder (4) and each secondary feeder (10) should be well-defined and, when there is a large number of elements, suitably low, the coupling means therebetween are shielded and non-conductive, suitably a directional coupler (17). To provide the shielding, the primary feeder (4) and coupling means may be formed in double-ground-plane line. In an arrangement suitable for an antenna wherein power may be supplied to either end of the primary feeder (4) to give radiation patterns having single main lobes with different angular orientations, for example for a Doppler navigation system, one port of each directional coupler (17) may have an open-circuit reflective termination. For a simple design in which the proportion of power coupled into the secondary feeders (10) varies along the primary feeder (4), the coupling value of the coupling means may vary step-wise from one group of adjacent secondary feeders (10) to another.

10 Claims, 2 Drawing Sheets

ANTENNA FORMED OF STRIP TRANSMISSION LINES WITH NON-CONDUCTIVE COUPLING

This is a continuation of application Ser. No. 233,871, filed Aug. 15, 1988, which is a continuation of application Ser. No. 939,191, filed Dec. 8, 1986.

BACKGROUND OF THE INVENTION

The invention relates to an antenna formed in strip transmission line, the antenna comprising a plurality of conductive strip antenna elements distributed over an antenna aperture which extends in each of two mutually perpendicular directions, and feeding means for supplying energy to the elements. The feeding means comprise an elongate primary strip transmission line feeder for applying energy from a port coupled thereto and further comprise a plurality of secondary strip transmission line feeders coupled to the primary feeder at intervals therealong. Each of the secondary feeders is coupled at one end to the primary feeder, extends away therefrom and has a respective plurality of the antenna elements coupled to it at intervals therealong.

The invention relates particularly but not exclusively to such an antenna having two, three or four ports and radiation patterns which are respectively associated with the supply of energy to the antenna at the respective ports and which have respective single main lobes with substantially different respective angular orientations.

For convenience, references in this specification to the operation of an antenna generally relate (as above) to the supply of power to the antenna, i.e. to use of the antenna for transmission, but might equally well relate mutatis mutandis to the derivation of power from the antenna, i.e. to use of the antenna for reception.

The invention is especially applicable to antennae having a large number of antenna elements, for example a hundred elements and possibly many hundreds of elements. Such an antenna may be used to produce a main lobe having a fairly narrow 3 dB beamwidth, for example in the range 1–20°. An example is an antenna in a Doppler navigation system for an aircraft, for which it may be desirable to have a beamwidth of approximately 5°.

An antenna as set forth in the opening paragraph, intended for a Doppler navigation system, is known from the paper "A Printed Circuit Antenna for a Doppler Navigator" by M. Scorer and B. J. Adams, IEE Colloquium on Advances in Printed Antenna Design and Manufacture, London, 18th Feb., 1982, pages 7/1 to 7/8. The means used in that antenna for coupling energy from the primary feeder to the secondary feeders are strip-conductor T-junctions with a 2-section transformer in each secondary feeder adjacent the junction. T-junctions have also been used in other multi-port antennae employing strip transmission line means for supplying power to the radiating elements: see for example U.K. Patent Application 2 107 936 B and the paper "A Printed Antenna/Randome (Radant) for Airborne Doppler Navigational Radar" by T. W. Bazire, R. Croydon and R.H.J. Cary, International Conference on Antennas for Aircraft and Spacecraft, June, 3–5, 1975, London, pages 35–40. However, the proportion of power supplied at such a junction cannot always be accurately controlled; furthermore, there is effectively a lower limit to the proportion of power supplied to the side arm of such a junction (in this application of the junction, from the primary to the secondary feeder). This problem becomes particularly acute if the antenna has a large number of elements, for example several hundred, with a substantial number of secondary feeders, and/or if the operating frequency is relatively high, for example in $K_a$ band (e.g. around 30 GHz), in which case the widths of strip transmission line conductors with typical thicknesses of substrate and for typical impedances tend to be fairly large in terms of wavelength but small in absolute terms, effectively limiting the practicable aspect ratios of the lines at a junction. Furthermore, with regard to controlling the proportion of the power available to each antenna element that is actually radiated thereby, in order to tailor the illumination across the antenna aperture, there is an analogous limitation on the range of radiation conductances that can be obtained by varying the widths of the antenna elements.

The antenna described in the above-mentioned paper by Scorer and Adams is intended for operation at about 13 GHz and uses nine secondary feeders each with a large number of antenna elements coupled thereto, there being a small taper along the primary feeder. This probably lies close to the limit of what is practicable using T-junctions. It is desirable to provide an alternative arrangement which can enable a larger number of secondary feeders to be used if desired, for example to achieve a narrower beam width in the general direction of the primary feeder, and/or which is more suitable for use at higher frequencies.

The problem is especially severe if, as in the above-mentioned known antennae, the antenna has at least two ports with associated respective radiation patterns. The general nature of the problem is as follows. To achieve low sidelobe levels, a well-tailored distribution of power across the antenna aperture must be achieved. To obtain two radiation patterns whose main lobes have different angular orientations, it is necessary to supply energy from ports on opposite sides of the antenna aperture to an array of elements distributed across the aperture. The further an element is from the port at which energy is being supplied, the less energy will generally be available to it, since a substantial proportion of the energy supplied at the port will already have been radiated by elements closer to that port. It is therefore desirable that elements which are relatively close to a port should only accept a small proportion of the available power, in order to leave some power for those elements which are relatively remote from the port. However, elements which are relatively close to one of two ports are relatively remote from the other of those ports, and, if designed to accept only a small proportion of available power in order not to use too much power when energy is supplied at the nearby port, will radiate a fairly negligible amount of power when energy is supplied to the other, relatively remote part. The variation with distance from a port in the proportion of power supplied to elements therefore needs to be carefully selected to achieve a suitable compromise, and the values actually achieved in a constructed antenna should preferably be close to the theoretical design values if repeated modifications are to be avoided.

SUMMARY OF THE INVENTION

According to the invention, an antenna as set forth in the opening paragraph is characterized in that each of the secondary feeders is coupled to the primary feeder by respective shielded non-conductive coupling means.

By using non-conductive coupling means, the coupling value can be more accurately controlled, the example by varying the width of a coupling gap, and relatively low values of coupling can be more easily achieved, which is particularly desirable for an antenna with a large number of elements. By shielding the coupling means, radiation from the coupling means can be kept low so as not substantially to effect the radiation pattern(s) of the antenna, which again is particularly desirable if there are a large number of elements so that the contribution from an individual element is small and the overall radiation pattern of the antenna is susceptible of disturbance by sources of stray radiation.

It may be noted that an antenna formed in strip transmission line and using capacitive coupling to arrays of elements is known from the paper "Recent Developments in the Study of Printed Antennas" by J. A. McDonough et al, I.R.E. National Convention Record, 1957, pages 173–176. However, instead of there being a plurality of secondary feeders each coupled at one end to a primary feeder from which the secondary feeders extend away with a respective plurality of antenna elements coupled to each secondary feeder, a plurality of linear arrays of antenna elements extend transversely to a primary feeder on each side thereof with the elements being capacitively coupled end-to-end directly to one another and to the primary feeder; the means for coupling the elements to the primary feeder form an essential radiating portion of each linear array. Furthermore, the antenna uses a total of only 40 elements so that relatively low coupling values are not required, nor is there any suggestion of varying the coupling across the antenna aperture in the direction of the primary feeder.

Suitably, each coupling means comprises a directional coupler, which may be readily designed and constructed to provide a desired value of coupling. With a directional coupler, the primary feeder forming first and second ports of the coupler, the respective secondary feeder may be connected to a third port of the coupler and the fourth port may have a reflective termination, which suitably is an open-circuit immediately adjacent the coupler. This arrangement is particularly suited to an antenna wherein energy is to be supplied to the elements in each direction along the feeder.

To ensure low radiation from the primary feeder and to enable good shielding of the coupling means, the primary feeder and the coupling means may form parts of a double-ground-plane shielded strip transmission line. In that case, for a fairly simple construction, the antenna may be formed on a dielectric substrate having a conductive strip pattern on one major surface thereof and a conductive ground plane on the other major surface thereof, the primary feeder comprising a further ground plane spaced from the conductive strip pattern by a layer of dielectric. In order to further shield the coupling means, the ground planes may be conductively connected along the edge of the further ground plane on the side of the primary feeder from which the secondary feeders extend, around each secondary feeder.

To simplify the design and construction of an antenna wherein the coupling to the secondary feeders varies along the primary feeder, the respective coupling means for adjacent secondary feeders may have the same coupling value, the coupling value varying along the primary feeder from one group of adjacent secondary feeders to another.

The invention is well suited to an embodiment in which an antenna has first and second ports respectively coupled to opposite ends of the primary feeder. The antenna has first and second radiation patterns which are respectively associated with the supply of energy to the antenna at the first and second ports and which have respective single main lobes with substantially different angular orientations. At their ends remote from the primary feeder, the secondary feeders may be analogously coupled to a further primary feeder at intervals therealong, and the further primary feeder may have a port coupled to one end thereof or respective ports coupled to opposite ends thereof, so that the antenna may have three or four radiation patterns which are respectively associated with the supply of energy to the antenna at the different ports and which have respective single main lobes with substantially different angular orientations.

BRIEF DESCRIPTION OF THE DRAWING

An embodiment of the invention will now be described, by way of example, with reference to the diagrammatic drawings, in which.

DESCRIPTION OF THE PREFERRED EMBODIMENT

Figure 1:
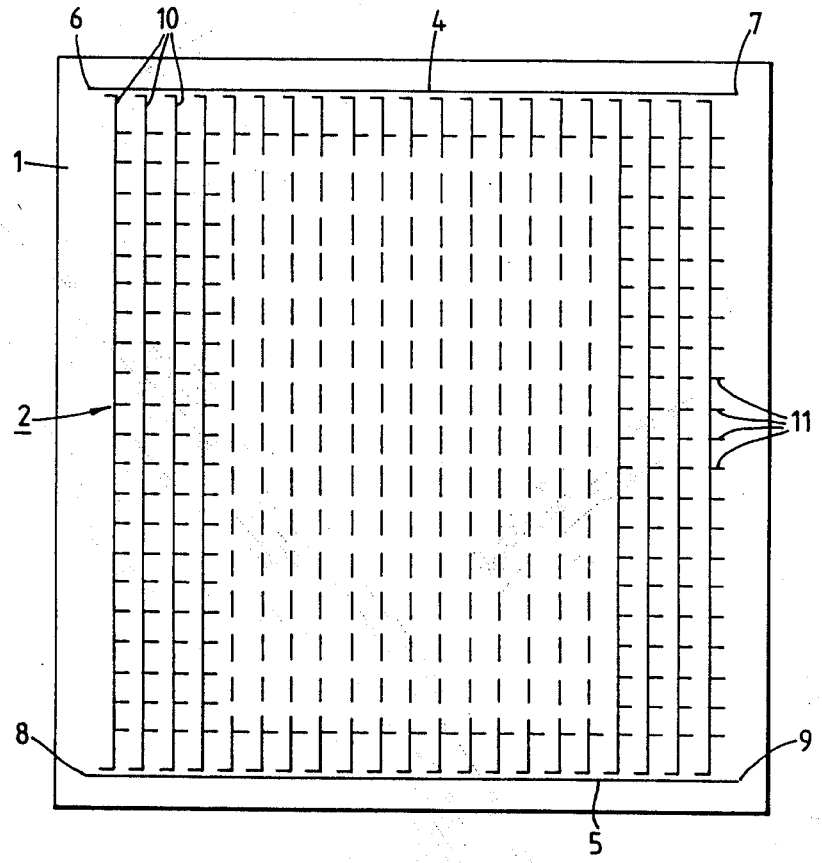
FIG. 1 is a schematic plan view of a substrate bearing a conductor pattern for an antenna embodying the invention.
Figure 2:
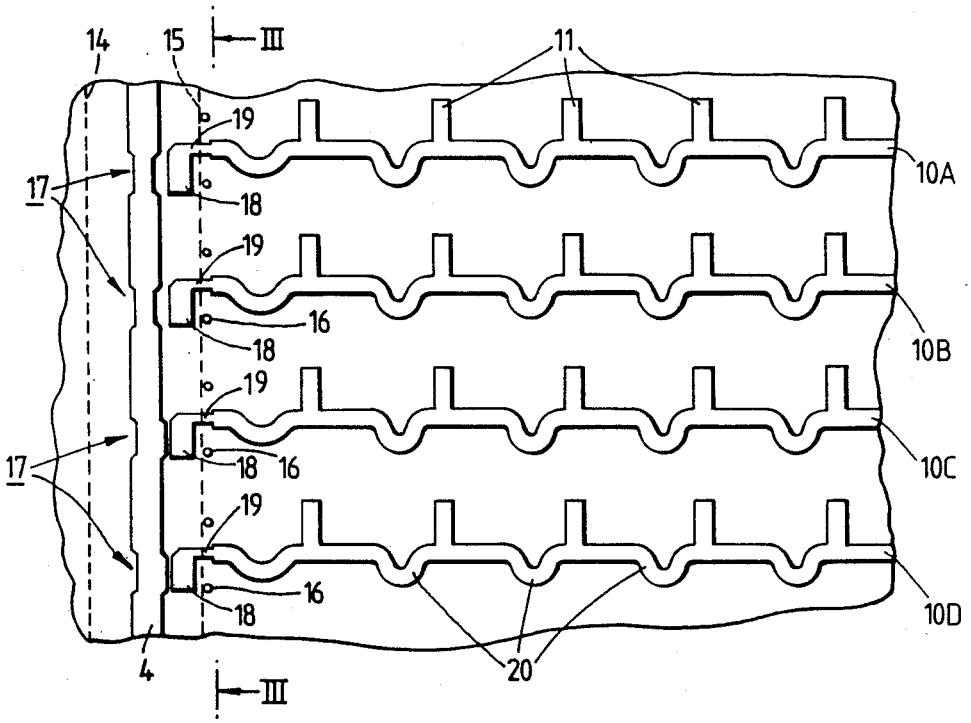
FIG. 2 shows in more detail a portion of the conductor pattern, together with other features of the antenna.
Figure 3:
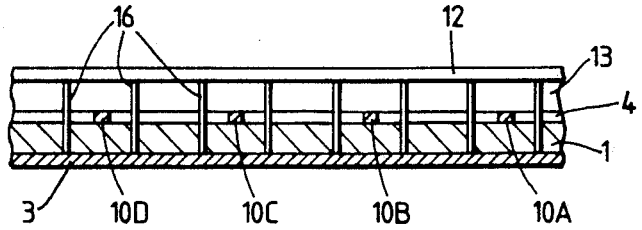
FIG. 3 is a cross-sectional view of the line III—III in FIG. 2 of a portion of the antenna.

Referring to FIGS. 1–3, a four-port antenna embodying the invention comprises a planar substrate 1 of fairly low dielectric constant (for example about 2.2) bearing on one major surface a strip conductor pattern 2 (FIG. 1) and on the other major surface a conductive ground plane 3 (FIG. 3). The strip conductor pattern 2 comprises two parallel elongate conductors 4 and 5 on opposite sides of the antenna, forming primary feeders of the antenna; opposite ends of conductor 4 form first and second ports 6 and 7 respectively of the antenna, and opposite ends of conductor 5 form third and fourth ports 8 and 9 respectively. The conductor pattern further comprises a plurality of regularly-spaced strip conductors 10 (only some of which are shown in full) extending orthogonally to the conductors 4 and 5 and coupled thereto at their ends to form secondary feeders of the antenna.

Each of the secondary feeders has a plurality of half-wavelength stubs 11 as radiating elements connected thereto at spaced intervals therealong, the stubs extending orthogonally to the secondary feeders to form an array of elements regularly distributed across the antenna aperture, which in this embodiment is square. The electrical and physical spacing of the stubs is such that the supply of electromagnetic energy at the design operating frequency to any one of the four ports 6–9 produces a respective radiation pattern with a single main lobe (i.e. without grating lobes) inclined to the normal of the center of the substrate 1. The main lobes of the four patterns are each inclined to the normal at substantially the same angle but in a respective sense. The main lobes of the radiation patterns associated with the supply of energy to the respective ports are in each case backward-firing and in this embodiment extend over the diagonals of the antenna aperture.

The secondary feeders are coupled to the primary feeders by means of directional couplers, and each of the primary feeders is formed as a double-ground-plane shielded strip transmission line; the two ground planes also shield the coupling between the primary and secondary feeders. FIGS. 2 and 3 show, on an enlarged scale, a portion of the primary feeder 4 and the adjacent portion of a set of four adjacent secondary feeders 10A–10D with their attached radiating elements. The two ground planes of the primary feeder are respectively the ground plane 3 on the lower major surface of the substrate 1 and a further conductive ground plane 12 covering the upper surface of a dielectric layer 13 overlaying the substrate 1. The location of the longitudinal edges of the ground plane 12 and the layer 13 are denoted in FIG. 2 by dashed lines 14 and 15. To provide additional shielding, the ground plane 12 and the ground plane 3 are electrically connected together on the side of the primary feeder from which the secondary feeders emerge by wires 16 which extend through the substrate 1 and which are regularly spaced along the edge 15, there being two wires between each pair of adjacent secondary feeders 10. Edge 14 of the ground plane 12 and the ground plane 3 are also conductively connected, in that case by a wrap-around connection (not shown) providing complete shielding.

The directional couplers which provide coupling between the primary and secondary feeders are denoted 17 in FIG. 2. Each coupler is of the proximity kind and comprises essentially a quarter-wavelength portion of the strip conductor 4, the ends of the portion forming first and second ports of the coupler, and a parallel strip conductor 18 the ends of which form third and fourth ports of the coupler. This strip conductor 18 is also a quarter-wavelength long and is separated from the strip conductor 4 by a narrow gap, on the width of which the coupling ratio is primarily dependent. To provide the appropriate energy distribution across the antenna aperture in the direction of the primary feeder, the value of the coupling ratio varies along the primary feeder; in this embodiment, to simplify the design, there are only three values which are allocated to five groups of adjacent feeders (the value being the same for all members of a group) so that the coupling value varies stepwise from a minimum of each end of the primary feeder to a maximum at its center. Different groups may have different numbers of members. In the portion of the antenna depicted schematically in FIG. 2, secondary feeders 10A and 10B are members of a group with a relatively lower coupling value, and feeders 10C and 10D are members of an adjacent group with a relatively higher coupling value. In this embodiment, the strip conductors 18 form (with the ground planes) transmission lines of substantially the same characteristic impedance (50 ohms) as the primary feeder; however, the secondary feeders 10 have in this case a higher characteristic impedance (100 ohms), and a quarter-wavelength transformer 19 is therefore included between each directional coupler and the main part of its associated secondary feeder. (To eliminate the transformer, the strip conductors 18 could alternatively each be formed in the appropriate narrower width.)

To provide appropriate coupling between the primary and secondary feeders for energy travelling along the primary feeder in either direction, the secondary feeders are connected to corresponding third ports of their associated directional couplers and the corresponding fourth ports are terminated in open-circuits at the ends of the strip conductors 18. As a result, for energy travelling along the primary feeder in one direction (in this embodiment, in the direction 10A to 10D), a small proportion (in the coupling ratio) is coupled directly into the secondary feeder. For energy travelling in the opposite direction (10D to 10A), the same small proportion is initially coupled to the open-circuited fourth port where it is reflected, after which a small proportion (in the coupling ratio) of the coupled power is coupled back into the primary feeder while the remainder passes into the secondary feeder. Consequently, there will be a slight difference between the effective coupling values for the two directions of propagation along the primary feeder, but with the fairly low coupling values typically used for the directional couplers (for example around 10dB), the difference will usually be negligible. It may also be noted that as a result of the energy that is initially coupled to the open-circuited port having to travel back along the directional coupler to the secondary feeder, there is a 90° difference between the phases of the energy entering a secondary feeder relative to its phase at corresponding points in the primary feeder for the two directions of propagation along the primary feeder.

To provide a suitable energy distribution across the antenna aperture in the direction of the secondary feeders, the widths of the radiating elements 11 vary along the secondary feeders (not shown). For simplicity, there are (as with the coupling values of the directional couplers) only three values which are allocated to five groups of adjacent elements (the value being the same for all members of a group) so that the width (and hence the proportion of the energy supplied to an element that is radiated thereby) varies stepwise from a minimum at each end of the secondary feeder to a maximum at its center. Corresponding elements on the different feeders have the same widths. Since the antenna aperture is square and the main lobes are to extend over the diagonals, the stepwise variation along the primary and secondary feeders follows the same general pattern, with the same number of members in corresponding groups in the two directions (counting from one end of each kind of feeder). The value of the characteristic impedance of the secondary feeders of 100 ohms is chosen so the requisite variation in radiation along the secondary feeders can be obtained by varying the widths of the elements within a reasonable range.

To provide correct phasing of the elements and to compensate for the difference in phase velocities along the double-ground-plane and microstrip lines, the secondary feeders include a meander 20 between each pair of elements and between each directional coupler and the adjacent element. A quarter-wave transformer (not shown) may also be included between each pair of adjacent elements if desired to improve impedance matching.

Figure 4:
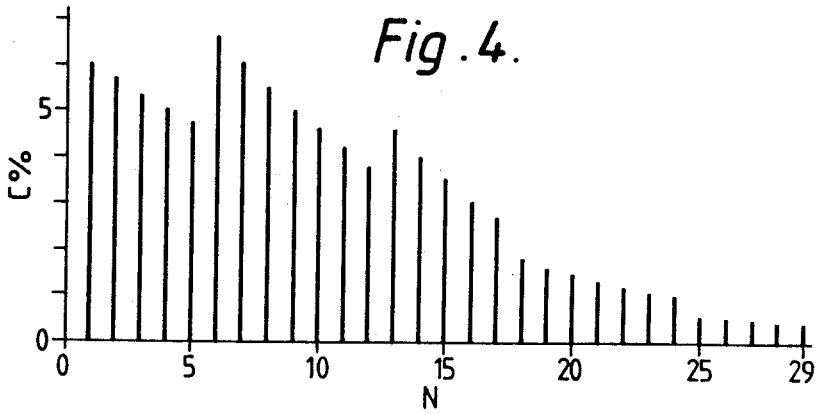
FIG. 4 is a graph showing the variation along the primary feeder of the proportion of power coupled into the second feeders.

An embodiment of the invention substantially as described with reference to the drawings has been designed for operation at about 33 GHz with radiation patterns having a main lobe 3dB beamwidth of 5° and sidelobe levels below 20 dB. The array is of 29×29 elements (i.e. 29 secondary feeders each with 29 elements). The values selected for the coupling of the directional couplers are approximately 12 dB, 10 dB and 9 dB, there being two groups of five secondary feeders, one at each end of the primary feeder, with the lowest coupling, two groups of seven feeders with the intermediate coupling value, and a central group of six feeders with the highest coupling. FIG. 4 is a bar graph showing the calculated variation along the primary feeder in the proportion of the total power supplied to the primary feeder that is supplied to each secondary feeder, plotted as the percentage C of the total power against the number N of the secondary feeder counting from the end of the primary feeder to which power is supplied. The power distribution is relatively uniformly maintained up to around the mid-point of the primary feeder, after which the power supplied to the secondary feeders inevitably decreases to a fairly low level relative to the power that it supplied to the secondary feeders close to the end of the primary feeder to which power is fed. However, some power is still available for radiation by the elements on secondary feeders remote from the port to which energy is supplied, but nevertheless the sum of the values of C from N=1 to N=29 represents more than 92% of the total power supplied, leaving less than 8% to be dissipated in terminating loads.

To test the design, an antenna array forming approximately a quarter of the total design at one corner thereof (15×15 elements) was constructed. This produced a radiation pattern having a main lobe that was approximately symmetrical with a 3 dB beamwidth of about 8°, and a maximum sidelobe level of −19 dB. The substrate was RT/duroid 5880 with a dielectric constant of 2.2 and having a thickness of 1/32 inch.

The invention may be embodied in a planar or, more generally, conformal antenna on, for example, an aircraft.

I claim:

1. An antenna comprising a substrate supporting strip transmission line conductors distributed over an area defining a radiation aperture, said antenna including:

a. an elongate primary strip transmission line having an end thereof defining a feeder port and having a multiplicity of coupling portions of predetermined dimensions disposed at predetermined positions therealong;

b. a multiplicity of coupling strip conductors extending parallel to respective ones of the coupling portions of the primary strip transmission line, each of said strip conductors having predetermined dimensions and being spaced at a predetermined distance from said respective coupling portion;

c. a multiplicity of elongate secondary strip transmission lines, each having a first end electrically connected to a first end of a respective one of the strip conductors and extending away from the primary strip transmission line; and d. shielding means disposed adjacent coupling spaces defined by said predetermined distances from the coupling portions to the coupling strip conductors for minimizing radiation from the antenna of energy coupled between said coupling portions and said coupling strip conductors;

the predetermined dimensions of the coupling portions and of the strip conductors and the predetermined distances therebetween being established to effect differing predetermined degrees of energy coupling between the primary strip transmission line and the secondary strip transmission lines and to effect production of a predefined radiation pattern.

2. An antenna as in claim 1 where each of the coupling portions and the respective strip conductors forms a directional coupler.

3. An antenna as in claim 2 where each of the strip conductors has a second end with a reflective termination.

4. An antenna as in claim 3 where each of the reflective terminations comprises an open circuit.

5. An antenna as in claim 1 including first and second group planes between which the strip transmission line conductors and the coupling strip conductors are disposed.

6. An antenna as in claim 5 including a dielectric substrate having a first side on which the strip transmission line conductors are disposed and having an opposite side on which the first ground plane is disposed, said second ground plane being disposed adjacent the first side above the primary strip transmission line conductor and being separated therefrom by a dielectric.

7. An antenna as in claim 6 where the second ground plane extends to an edge thereof disposed above the ends of the secondary transmission lines, said antenna including means for conductively connecting the first ground plane to said second ground plane at said edge.

8. An antenna as in claim 1 where the coupling portions and their respective coupling conductors are arranged in groups having the same degree of energy coupling, each of said groups including a predetermined number of successive ones of said coupling portions.

9. An antenna as in claim 1 where the primary strip transmission line has first and second feeder ports at respective opposite ends of said line, and where the coupling portions, the coupling strip conductors and the distances therebetween are dimensioned such that the coupling of energy at the first port produces a first predefined radiation pattern and the coupling of energy at the second port produces a second predefined radiation pattern which is different from said first pattern.

10. An antenna as in claim 9 where the first and second predefined radiation patterns have respective main lobes with substantially different angular orientations.

* * * * *